US005984447A

United States Patent [19]

Ohashi

[11] Patent Number: 5,984,447

[45] **Date of Patent: *Nov. 16, 1999**

[54] L-SHAPED INKJET PRINT HEAD IN WHICH DRIVING VOLTAGE IS DIRECTLY APPLIED TO DRIVING ELECTRODES

[75] Inventor: Yumiko Ohashi, Hashima, Japan

[73] Assignee: Brother Kogyo Kabushiki Kaisha, Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/635,655

[22] Filed: Apr. 22, 1996

[30] Foreign Application Priority Data

May 10, 1995 [JP] Japan ..... 7-137317

[51] Int. Cl.[6] ..... B41J 29/38

[52] U.S. Cl. ..... 347/9; 347/71; 310/345; 310/363

[58] Field of Search ..... 347/9, 20, 43, 347/69, 68, 50; 310/330–334, 328, 358, 345, 363

[56] References Cited

U.S. PATENT DOCUMENTS

| | | | |
|---|---|---|---|
| 5,016,028 | 5/1991 | Temple | 347/69 |
| 5,255,016 | 10/1993 | Usui et al. | 347/71 |
| 5,345,256 | 9/1994 | Stortz | 347/20 |
| 5,367,324 | 11/1994 | Abe et al. | 347/43 |
| 5,402,162 | 3/1995 | Fusting et al. | 347/43 |
| 5,619,235 | 4/1997 | Suzuki | 347/69 |
| 5,696,545 | 12/1997 | Ochiai et al. | 347/69 X |

FOREIGN PATENT DOCUMENTS

| | | | |
|---|---|---|---|
| 4259565 | 9/1992 | Japan | 347/69 |
| 4292948 | 10/1992 | Japan | 347/69 |

OTHER PUBLICATIONS

Richard J. Lewis, Sr. *Hawley's Condensed Chemical Dictionary*, 12th Edition, 1993 pp. 47 and 240.

Patent Abstracts of Japan, vol. 16, No. 490, Oct. 12, 1992, JP–4–180984 (Hitachi Chem. Co. Ltd).

*Primary Examiner*—John Barlow
*Assistant Examiner*—C. Dickens
*Attorney, Agent, or Firm*—Oliff & Berridge, PLC

[57] ABSTRACT

An ink jet print head is provided with high integration in which a substrate formed with a wiring pattern of a driver circuit is adhered to an actuator plate to provide a joined body, which is formed with a number of channels serving as ink chambers. An actuator is formed between the channels, and conductive films serving as driving electrodes are formed over the substrate and the actuator plate at a part of side walls of the channels by electrically connecting to a wiring pattern by an oblique vapor deposition method and an electrolytic plating method. Accordingly, voltage can be directly applied to the driving electrodes from the driver circuit.

15 Claims, 8 Drawing Sheets

L-SHAPED INKJET PRINT HEAD IN WHICH DRIVING VOLTAGE IS DIRECTLY APPLIED TO DRIVING ELECTRODES

BACKGROUND OF THE INVENTION

1. Field of the Invention

The present invention relates to an ink jet print head for expelling ink from a number of nozzles to a print sheet for printing and a method for producing the same. More specifically, this invention relates to an ink jet print head in which a driving electrode of an actuator corresponding to each of nozzles is directly connected to wiring of a driver circuit formed on a substrate, and a method for producing the same.

2. Description of Related Art

Commonly, in ink jet print heads of an on-demand system used for an ink jet printer, the print head is a piezo system in which a piezoelectric element is used for the actuator. This print head has advantages in that the type of ink used is less limited since heat is not generated and its durability is excellent, as compared with a bubble jet print head in which a heat generating element is used for the actuator. The integration and miniaturization, which have been considered to be a weak point in the conventional piezo type, are improved by making use of a modification of a shear mode of the piezoelectric element, as disclosed, for example, in U.S. Pat. No. 5,016,028 (JP-A-2-150355). In recently designed ink jet print heads, considerable integration and miniaturization have been achieved.

The schematic construction of the conventional ink jet print head of this kind will be explained with reference to the drawings while referring also to a method for the production thereof. As shown in FIG. 10, which is an exploded perspective view, the print head comprises a ceramic plate 102 formed from a piezoelectric element, a cover plate 103 for covering the top thereof, a nozzle plate 131 formed with nozzles 132 from which ink is expelled, and a substrate 141 adhered to the lower surface of the ceramic plate 102.

The ceramic plate 102 is a plate made of ferroelectric ceramic material such as lead zirconate titanate (PZT) formed with a number of parallel channels 108. Each channel 108 is provided with a deep channel portion 117 and a shallow channel portion 116, between which is disposed an curved transition R portion 119. This channel 108 is preferably formed by a diamond cutter blade. The ceramic plate 102 is applied with polarization processing in a direction of the arrow P. Thereby, a side wall 111 between the channels 108 is polarized in that direction. Each channel 108 is formed at a depthwise upper half of the side thereof with an electrode 113, which is preferably a metal vapor-deposition film. The electrode 113 also covers the bottom surface of the shallow channel portion 116. The electrode 113 is formed by inclining the ceramic plate 102 at a suitable angle relative to a vapor deposition source and applying the vapor deposition twice from both sides.

For the cover plate 103, a ceramic or resin material is used, which is formed with an ink inlet 121 and a manifold 122. These are formed by grinding or cutting processing. The cover plate 103 is assembled by bonding the surface formed with the manifold 122 to the surface formed with the channel 108 of the ceramic plate 102 with an adhesive.

The nozzle plate 131 is a preferably plastic plate assembled by adhering the ends of the ceramic plate 102 and the cover plate 103. A nozzle 132 is provided at a position corresponding to each of the channels 108. The substrate

141 is formed with conductive pattern 142 at positions corresponding to each of the channels 108, with each conductive pattern 142 being connected to an electrode 113 of a channel 108 (the bottom portion of the shallow channel portion 116) by a conductor 143. This connection is done by wire bonding. Alternatively, this connection is sometimes made using a flexible substrate (FPC substrate) in place of the wire bonding. In this case, the electrode 113 is drawn to the plane portion from the shallow channel portion 116, with which an electrode pattern of the FPC substrate is registered, and they are joined by solder.

In the assembled print head, as shown in FIG. 11 which is a sectional view, the upper surfaces of the channels 108 are closed by the cover plate 103 to form a plurality of ink chambers 112. Ink is supplied to and filled in the ink chambers 112 via the ink inlet 121 and the manifold 122 of the cover plate 103.

In the thus configured print head, a positive driving voltage is applied to an electrode 113B of a specific ink chamber 112B by a driver circuit provided externally. When electrodes 113A and 113C of ink chambers 112A and 112C are grounded, electric fields reversed to each other are generated in side walls 111A and 111B to deform the ink chamber 112B so as to reduce the volume thereof, as shown in FIG. 12. Thus, ink is jetted out of the nozzles 132 in communication with the ink chamber 112B of the nozzle plate 131 for printing. When the application of the driving voltage stops, the side walls 111A and 111B return to the FIG. 11 state, and the ink chamber 112B is replenished with ink via the ink inlet 121 and the manifold 122.

However, the conventional ink jet print head and method for producing the same as described above have the problem described below. That is, since the contact between the electrodes 113 of the channels 108 and the driver circuit is made by the wire bonding through the conductive pattern 142 of the substrate 141, the same number of bonding elements as that of the channels 108 is necessary. Further, the channel 108 must have a complicated shape including the shallow channel portion 116 because ink cannot be allowed to pass through the conductor 143, which must be sealed. Accordingly, not only the fabrication step for the wire bonding and the processing step for formation of channels are complicated, but also the cost required therefor greatly increases as the high integration progresses.

Further, since the control of the electrodes 113 must be done via each conductor 143 subjected to the wire bonding, a driver circuit formed into a matrix cannot be used. Because of this, a number of individual diodes are used to assemble the driver circuit, which requires very many parts, thus impeding the provision of a high integration.

Even in the case where the FPC substrate is used in place of the wire bonding, it is necessary to make the pitch of the electrode pattern of the FPC substrate narrow to correspond to the channels 108 of the ceramic plate 102, similarly posing a problem of cost. Even in the case where wire bonding and FPC substrate are used, the cost for high integration increases, thus impeding the improvement in resolution of the print head.

SUMMARY OF THE INVENTION

The present invention is proposed to solve at least the problems noted above with respect to the prior art. An object of the embodiments of the present invention is to provide an ink jet print head and a method for producing the same, in which electrodes of an actuator are placed in contact with a wiring of a driver circuit directly, without intervention of wire bonding or the like, whereby high integration can be achieved by a simple production step. A further object of the invention is to provide a method for producing an ink jet print head in which a semiconductor substrate formed with a driver circuit and an actuator are integrally formed with electrodes. Another object of the invention is to provide a method for producing an ink jet print head in which a substrate formed with a wiring pattern connected to a driver circuit and an actuator are integrally formed with electrodes. Still another object of the invention is to reduce the number of parts by forming the driver circuit into a matrix.

For achieving the aforementioned and other objects, this invention provides an ink jet print head comprising a number of ink chambers filled with ink, nozzles provided in conjunction with the ink chambers, a piezoelectric actuator for separately contracting the ink chambers, and a driver circuit for driving the piezoelectric actuator. The print head further comprises a substrate mounted on the piezoelectric actuator formed with outgoing wiring to the driver circuit, and driving electrodes integrally formed on the piezoelectric actuator and the substrate and connected to the outgoing wiring.

Preferably, the substrate comprises a semiconductor substrate, and the driver circuit is formed on the semiconductor substrate. Alternatively, the driver circuit may be formed as an integrated circuit.

The present invention further provides a method for producing an ink jet print head in which ink chambers are contracted by a piezoelectric actuator to expel ink from nozzles. The method includes the steps of: affixing a substrate formed with outgoing wiring to a driver circuit for driving the piezoelectric actuator and a piezoelectric plate; forming a number of channels to serve as ink chambers over the affixed substrate and piezoelectric plate, the area between which channels serving as the piezoelectric actuator; and forming conductive films as driving electrodes over the substrate and piezoelectric plate at a part of side walls of the channels by electrically connecting them to the outgoing wiring.

Preferably, the substrate to be affixed to the piezoelectric plate in the affixing step comprises a semiconductor substrate, and the driver circuit is preformed on the semiconductor substrate.

Preferably, the electrode forming step is carried out by being divided into a first step for forming a primary film by an oblique vapor deposition method and a second step for forming a main film by an electrolytic plating method.

In the ink jet print head according to the present invention constructed as described above, a driving voltage generated by the driver circuit is directly applied to the driving electrode from the outgoing wiring formed on the substrate. Then, the piezoelectric actuator corresponding to the driving electrode applied with the driving voltage contracts the ink chamber to expel the ink from the nozzle provided in the ink chamber for printing. Since the outgoing wiring and the driving electrode are directly connected as described, high integration and miniaturization are easily attained. Further, if the driver circuit is formed on the semiconductor substrate, the driving voltage can be directly applied to the driving electrode from the driver circuit. Further, if the driver circuit is formed as an integrated circuit, the number of parts can be greatly reduced.

Further, in the method for forming an ink jet print head according to the present invention, first, in the affixing step, the substrate is affixed to the piezoelectric plate. This substrate provides an outgoing wiring for communication between the driving electrode of the piezoelectric actuator and the driver circuit. The wiring pattern is preformed on the substrate. A semiconductor substrate can be used as a substrate. In this case, the driver circuit may be formed on the substrate in addition to the outgoing wiring. This piezoelectric plate has a ferroelectric property and serves as an actuator for an ink jet print head. Such materials suitable for the plate include titanate, zirconate or a mixture of these, typically, PZT (titanate lead zirconate).

In the channel forming step, a number of channels are formed over the affixed substrate and piezoelectric plate. This channel serves as an ink chamber filled with ink. A projecting portion between the channels serves as a piezoelectric actuator for contracting the ink chamber. Since it is necessary to use the same number of the ink chambers as the number of nozzles, a large number of channels corresponding thereto must be formed.

In the electrode forming step, conductive films are formed over the substrate and piezoelectric plate at a part of side walls of the channel. This conductive film serves as a driving electrode for the piezoelectric actuator. The conductive film must be formed so as to be electrically connected to the outgoing wiring on the substrate. Thereby, the driving voltage applied to the outgoing wiring from the driver circuit is directly transmitted to the driving electrode to allow the piezoelectric actuator to contract the ink chamber.

Preferably, the electrode forming step is carried out by being divided into a first step for forming a primary film and a second step for forming a main film. In the first step, a conductive primary film is formed on a portion from an upper end out of side walls of the channel to a predetermined depth by an oblique vapor deposition method. The reason why the vapor deposition is carried out obliquely is that a primary film is not formed at a deeper portion than the predetermined depth out of the side walls of the channel making use of shadowing by the projecting portion between the channels, and that an electric contact with the outgoing wiring on the substrate is obtained. The materials for the primary film are not particularly limited as long as they have conductive properties, and normally, a metal such as nickel is used. This film serves as a primary film for forming the driving electrode.

In the second step, a main film is formed by an electrolytic plating method with the primary film used as a cathode. In this case, a plated layer is formed merely on the conductive primary film, which serves as a driving electrode. The materials for the plated layer are not particularly limited as long as they can be subjected to the electrolytic plating. However, suitable materials are preferably low in electric resistance. For example, gold is preferable.

As will be apparent from the foregoing explanation, according to the present invention, the outgoing wiring to the driver circuit is formed on the substrate mounted on the piezoelectric actuator, and the piezoelectric actuator is driven by the driving electrode connected to the outgoing wiring. Therefore, the ink jet print head has high integration in which the driving voltage is directly applied to the driving electrode. Further, the substrate is made to comprise a semiconductor substrate and the driver circuit is formed on the substrate, thus enabling construction of an inexpensive ink jet print head having the number of connections greatly reduced. Alternatively, the driver circuit is formed as an integrated circuit, thus enabling the construction of an inexpensive ink jet print head having the number of parts greatly reduced.

Furthermore, according to the present invention, the piezoelectric plate and the substrate are affixed together for integral channel formation and electrode formation, thus enabling the easy production of an ink jet print head of high integration in which driving electrodes and outgoing wiring are directly connected. Moreover, the outgoing wiring and the driver circuit are provided on the semiconductor substrate to render such production possible. Furthermore, the primary film is formed by the oblique vapor deposition method. Then, the main film is formed by the electrolytic plating method to provide a driving electrode of the piezoelectric actuator. Thus, construction of a driving electrode of low electric resistance, while satisfactorily maintaining the contact between the driving electrode and the outgoing wiring, is possible.

BRIEF DESCRIPTION OF THE DRAWINGS

Preferred embodiments of the present invention will be described in detail with reference to the following figures wherein.

DETAILED DESCRIPTION OF PREFERRED EMBODIMENTS

In the following, embodiments in which the present invention is embodied as an ink jet print head mounted on an ink jet printer will be described in detail with reference to the drawings.

Figure 1:
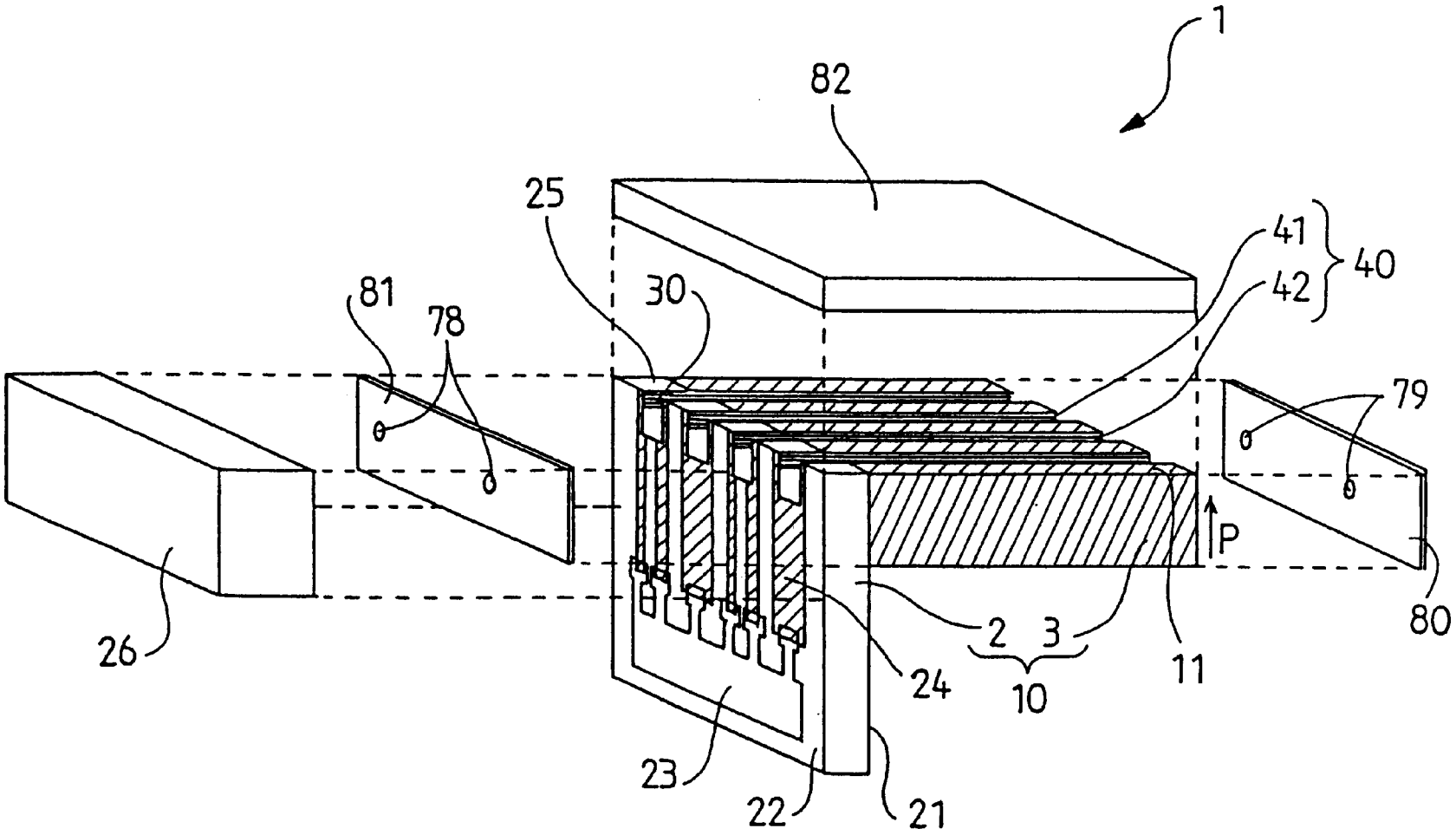
FIG. 1 is an exploded perspective view of an ink jet print head according to the first embodiment.

First, an ink jet print head 1 according to the first embodiment and a method for producing the same will be described. The ink jet print head 1 shown in FIG. 1, which is an exploded perspective view, is basically constructed such that an actuator plate 3 and a silicon substrate 2 are joined together, to which a nozzle plate 80, a back sealer plate 81 and a cover plate 82 are joined.

The actuator plate 3 is preferably a plate of ferroelectric titanate lead zirconate (PZT), having the size for example of about 5 mm*10 mm*2 mm. The actuator plate 3 is applied with polarization processing in a direction as indicated by the arrow P.

A top surface 11, for example the 5 mm*10 mm surface, of the actuator plate 3 is formed with a number of channels 40 parallel with the 5 mm side. While only four channels 40 are depicted in the figure, it is noted that in the preferred embodiment there are 128 channels 41 designed to be ink chambers and 129 dummy channels 42 not used as ink chambers arranged alternately therewith. The size of the channel 40 is such that both channel 41 and dummy channel 42 have a depth of preferably about 400 μm, a width of about 75 μm and a spacing of about 75 μm. The dummy channels 42 are provided to avoid a so-called crosstalk phenomenon between adjacent channels. A driving electrode 30 is formed in a portion within about 200 μm of depth out of side walls of each channel 40. The silicon substrate 2 is adhered to one of the 10 mm*2 mm side surfaces of the actuator plate 3.

The silicon substrate 2 is the same silicon wafer as that used for the LSI production. An upper end 25 of the silicon substrate 2 is cut into a shape similar to the channel 40 of the actuator plate 3, and the driving electrode 30 also extends on the section of the silicon substrate 2. In the silicon substrate 2, a non-mirror polished surface 21 is adhered to the actuator plate 3, and a mirror polished surface 22 is formed with a driver circuit 23 and a wiring pattern 24.

The driver circuit 23 is a circuit in which diodes, transistors and so on are incorporated as a matrix so that voltage of a voltage line is applied to the driving electrode 30 through the wiring pattern 24 or dropped to a ground potential. Each of the wiring patterns 24 is placed in electric contact with the corresponding driving electrode 30. The connection between the driver circuit 23 and a control circuit on the body side of the ink jet printer is preferably done by wire bonding.

The cover plate 82 is a plate adhered to the surface 11 formed with the channels 40 of the actuator plate 3, which closes the channels 40 to define ink chambers. The cover plate 82 also covers the upper end 25 of the silicon substrate 2 and is preferably made of alumina.

The nozzle plate 80 is adhered to the 10 mm*2 mm surface opposite to the silicon substrate 2 of the actuator plate 3, which is provided with a number of nozzle orifices 79 for expelling ink. The nozzle orifices 79 are provided at a position corresponding to the channels 41 of the actuator plate 3. Accordingly, the actual number of channels is 128 and a diameter thereof is approximately 35 μm. The surface of the nozzle plate 80 in contact with ink is applied with a hydrophilic processing while the opposite side thereof is applied with a repelling processing. Its material is preferably a polyimide sheet having a thickness of 100 μm. Other usable materials include polyalkylene (for example, ethylene), terephthalate, polyetherimide, polyetherketone, polyethersulfone, polycarbonate, cellulose acetate.

The sealer plate 81 is adhered to the surface formed with the wiring pattern 24 of the silicon substrate 2, and an ink supply hole 78 is formed at a position corresponding to the channel 41. An ink-containing ink tank 26 is joined to the sealer plate 81. Ink is supplied from the ink tank 26 via each of the ink supply holes 78 of the sealer plate 81 so that each ink chamber is filled with ink.

The printing operation of the ink jet print head 1 constructed as described above will be described below. When printing instructions are input to the ink jet printer, print data based on the instructions are input to the driver circuit 23 from the control circuit on the body side of the ink jet printer. Thus, the driver circuit 23 applies a positive driving voltage to the driving electrode 30 of the ink chamber of the channel corresponding to the print data to render the driving electrodes 30 of the dummy chambers next to each other at a ground potential. With this, an electric field perpendicular to the polarizing direction P is applied to the piezoelectric actuators on both sides between which the ink chamber is positioned by the driving electrodes, the direction of the field being reversed to both the piezoelectric actuators. Accordingly, both the piezoelectric actuators are deformed so as to reduce the volume of the ink chambers of the channels due to the electric strain effect to contract the ink chambers, so that the ink is expelled out of the nozzle orifices 79 corresponding to the ink chambers.

When the application of the driving voltage by the driver circuit 23 is stopped, the piezoelectric actuator returns to its original state so that the ink chamber receives a supply of ink from the ink tank 26 through the ink supply holes 78 of the sealer plate 81 to be ready for the next printing. In this returning operation, the so-called crosstalk phenomenon in which ink leaks from the channel next to the channel from which ink is expelled is eliminated by the presence of the dummy chambers provided alternately with the ink chambers.

The control circuit on the body side of the ink jet printer for carrying out the aforementioned driving control through the driver circuit 23 sends the voltage of the voltage line or a voltage of a ground line to the driver circuit 23 on the basis of a predetermined clock pulse according to the printing data input. This voltage is applied to the driving electrode 30 as required.

The above printing operation itself is substantially the same as that of the prior art previously described except the prevention of crosstalk after expulsion of ink, but is different in that a driving voltage or a ground potential output by the driver circuit 23 is applied to the driving electrode 30 directly without intervention of the wire bonding or the like.

Next, the method for producing the ink jet print head 1 will be described. First, the actuator plate 3 of 5 mm*10 mm*2 mm, the silicon substrate 2, the cover plate 82, the nozzle plate 80, the sealer plate 81 and the ink tank 26 are prepared.

The actuator plate 3 is applied with the polarizing processing in a direction as indicated by the arrow P, and a film resist is thermally pressed against the 5 mm*10 mm surface 11 using a laminator. This is done to separate an extra vapor deposition film in the post-electrode formation. On the other hand, in the silicon substrate 2, the driver circuit 23 and the wiring pattern 24 are prepared on the mirror polished surface 22 by a known technology for producing a semiconductor integrated circuit, i.e., film forming, photolithography, etching.

Then, the actuator plate 3 and the silicon substrate 2 are firmly bonded by using an epoxy adhesive. By this bonding, the 10 mm*2 mm surface of the actuator plate 3 and the non-mirror polished surface 21 of the silicon substrate 2 are affixed together, and the surface 11, to which is pressed the film resist of the actuator plate 3, faces the upper end 25 of the silicon substrate 2.

A joined body 10 of the actuator plate 3 and the silicon substrate 2 is formed with the channels 40 constituting the ink chambers and the dummy channels. The channels 40 are formed by cutting through the silicon substrate 2 and the actuator plate 3 using a diamond cutter blade. 257 channels 40 are formed, which have 75 $\mu$m of both width and spacing and 400 $\mu$m of depth. These constitute the alternating 128 ink chambers and 129 dummy chambers.

After this, the driving electrodes 30 are formed. In this formation, first, a primary film is formed only at a part of side walls of the channel 40 by an oblique vapor deposition method. Subsequently, a main film is formed only on the primary film by an electrolytic plating method.

Figure 2:
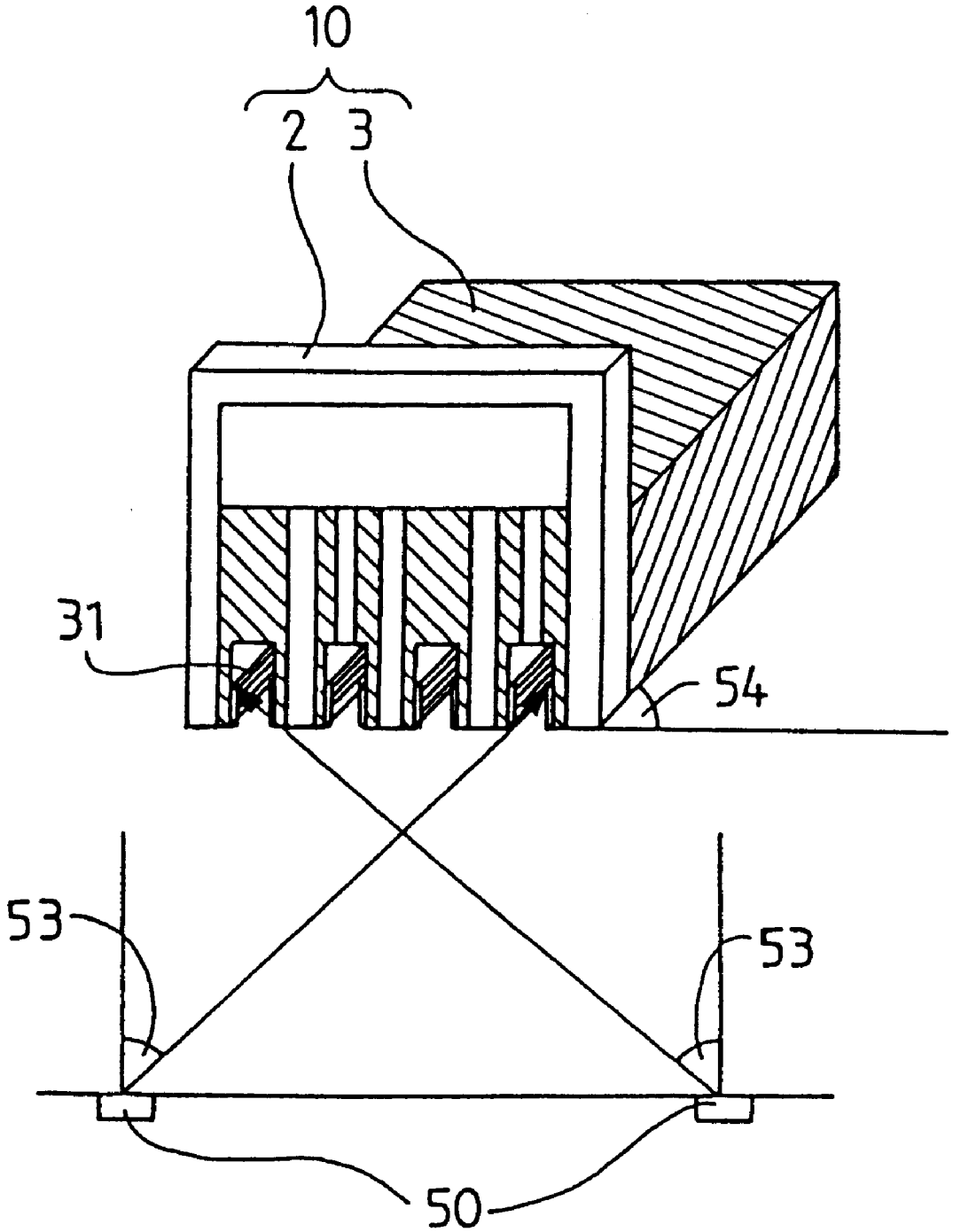
FIG. 2 is a view explaining the formation of a driving electrode in accordance with an oblique vapor deposition method.

After a resist has been coated on the mirror polished surface 22 and the upper end 25 of the silicon substrate 2, the joined body 10 is arranged obliquely as shown in FIG. 2, and vapor deposition is carried out from nickel vapor deposition sources 50, 50 placed obliquely downward. Here, incident angles 53, 53 from the nickel vapor deposition source 50, 50 to the joined body 10 are about 20° and a horizontal angle 54 in the arrangement of the joined body 10 is about 30°. The horizontal angle 54 is set at 30° to obtain the contact between the vapor deposition film and the wiring pattern 24 of the silicon substrate 2.

The incident angles 53, 53 are set at 20° to form a vapor deposition film only at a part of the side walls of the channel 40. That is, a vapor deposition film is not formed at a deep portion out of the side walls of the channel 40 due to a shadowing effect. Vapor deposition is done only on a part within a depth of 210 $\mu$m from 75/tan 20° 210 ($\mu$m) since the channel width is 75 $\mu$m. However, this includes a portion to be vapor-deposited on the resist. So, actually the depth is approximately 180 $\mu$m taking the resist thickness of 30 $\mu$m into consideration. This is about half of the depth of the channel 40.

The vapor deposition film is enough to have a thickness of about 0.2 $\mu$m on the side wall of the channel 40. After the vapor deposition, the film resist on the actuator plate 3 and the resist on the silicon substrate 2 are removed by an organic solvent. Then, the primary film 31 is obtained only at a part within 180 $\mu$m of depth out of the side walls of the channel 40. The primary film 31 obtained by the nickel vapor deposition is well adhered to any of the actuator plate 3, the silicon substrate 2 and an adhesive layer therebetween.

Next, the main film is formed. The joined body 10 formed with the primary film 31 is dipped into a gold plating bath. When the primary film 31 is subjected to electrolytic plating as a cathode, a gold plated film is formed only on the primary film 31. The gold plating bath is generally of a cyan bath, and a plating thickness of the order of 0.2 $\mu$m will be enough. In this plating, when the primary film 31 of the joined body 10 is energized from both the side of the silicon substrate 2 and the side opposite thereto, a more uniform film thickness is obtained. Usable plating metals may be those other than gold if they can be plated, but gold is excellent in view of a low electric resistance and an excellent adhesion. The excellent adhesion is important in securing the contact between the plated film and the wiring pattern 24 of the silicon substrate 2. As the plating method, a substitution plating method or a non-electrolytic plating method may be used in place of the electrolytic plating method.

After the driving electrode 30 has been formed, the cover plate 82 is adhered to the surface 11 of the actuator plate 3 by means of an epoxy adhesive. Thereby, the channels 40 are closed to define the ink chambers and the dummy chambers. The cover plate 82 has the size to cover not only the surface 11 of the actuator plate 3 but also the upper end 25 of the silicon substrate 2. Any material can be used, but ceramic, for example, alumina, is preferable.

The nozzle plate 80 is adhered to the surface opposite to the silicon substrate 2 of the actuator plate 3 by means of an epoxy adhesive. The nozzle plate 80 is provided in advance with the nozzle orifices 79 at positions corresponding to the channels 41 of the actuator plate 3. The forming processing is accomplished by an excimer laser, and the diameter of the nozzle orifice is approximately 35 $\mu$m. The nozzle plate 80 may be subjected, in advance, to hydrophilic processing for the surface in contact with the ink and to repelling processing to the surface opposite thereto. The hydrophilic processing includes ultraviolet irradiation in the atmosphere of ozone, and the repelling processing includes processing in which a compound having a hydrophobic group is sprayed or coated and or heated later. The hydrophobic group includes a methyl fluoride group. The material for the nozzle plate 80 is a polyimide sheet having a thickness of about 100 μm.

The sealer plate 81 is adhered to the upper end 25 of the silicon substrate 2 by means of an epoxy adhesive. The sealer plate 81 is formed in advance with the ink supply holes 78 at positions corresponding the channels 41 of the actuator plate 3 by excimer laser processing. Further, when the ink tank 26 is joined, the ink jet print head 1 is completed, in which state the print head 1 can be mounted on the body of the ink jet printer.

Figure 3:
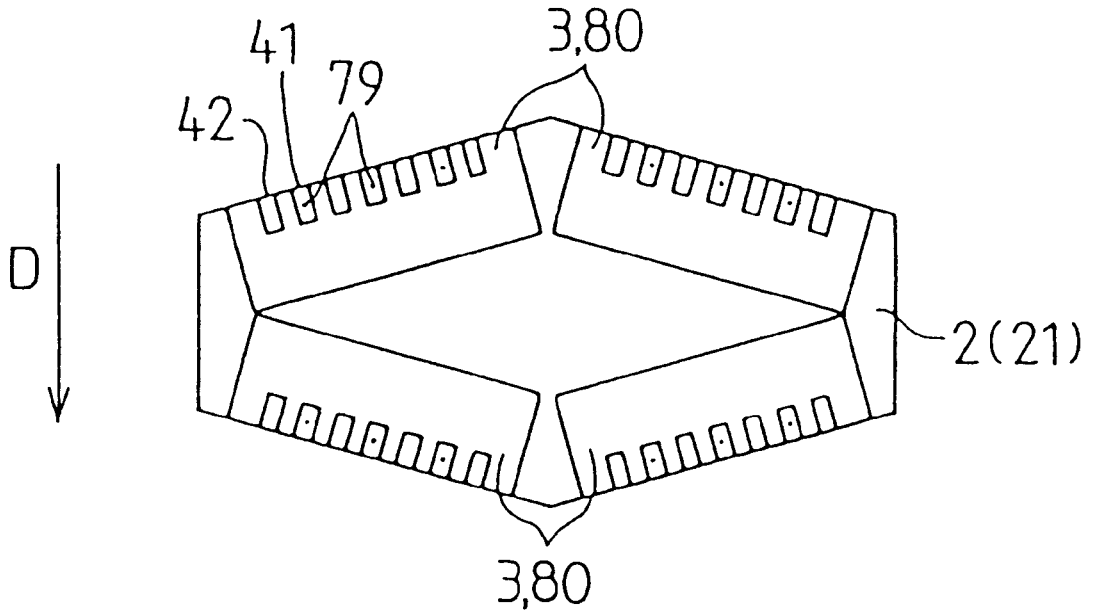
FIG. 3 is a front view of a four-color head unit.

This ink jet print head can be applied to a multi-color head unit. That is, as shown in FIG. 3, which is a front view (the surface on the nozzle side), four actuator plates 3 are arranged in the form of a diamond, to which is connected a single silicon substrate 2 to provide a unit provided with four print heads having a predetermined channel forming and electrode forming. When different color inks are supplied to the four print heads, a 4-color head unit is obtained. The direction indicated by the arrow D is the printing direction.

Figure 4:
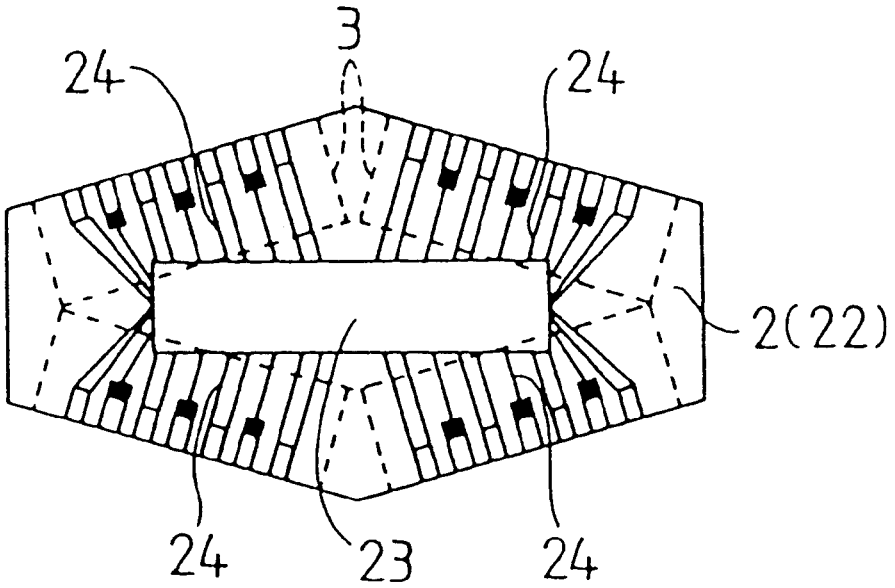
FIG. 4 is a rear view of the four-color head unit shown in FIG. 3.

In this case, the circuit pattern on the surface 22 of the silicon substrate 2 is that as shown in FIG. 4, which is the back view (the surface on the substrate side). The driver circuit 23 for driving four piezoelectric actuators is provided in the central portion of the diamond-shaped silicon substrate 2, and the wiring patterns 24 for connecting the driver circuit 23 to the driving electrodes. The diamond shape is designed so that the nozzle pitch relative to the printing direction D has a predetermined reference value (for example, 360 dots per inch). Alternatively, a matrix circuit is provided for each head, and a further matrix circuit is provided also between the heads so that the driver circuit 23 may be provided.

Figure 5:
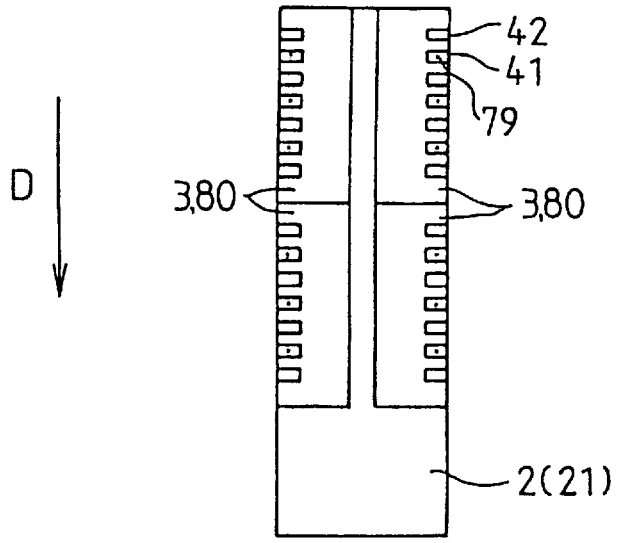
FIG. 5 is a front view of another four-color head unit.
Figure 6:
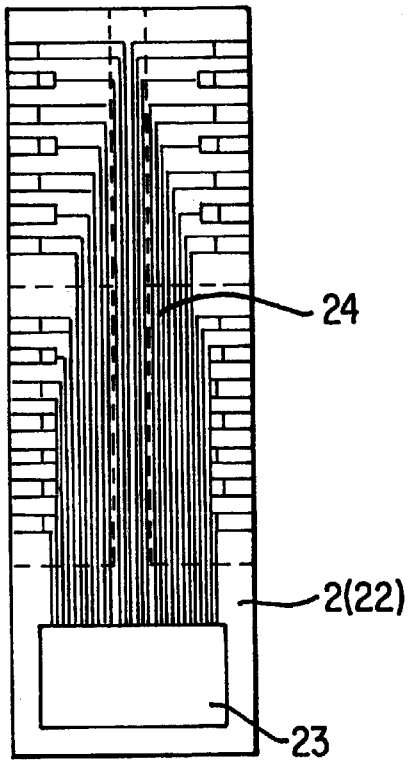
FIG. 6 is a rear view of the four-color head unit shown in FIG. 5.
Figure 7:
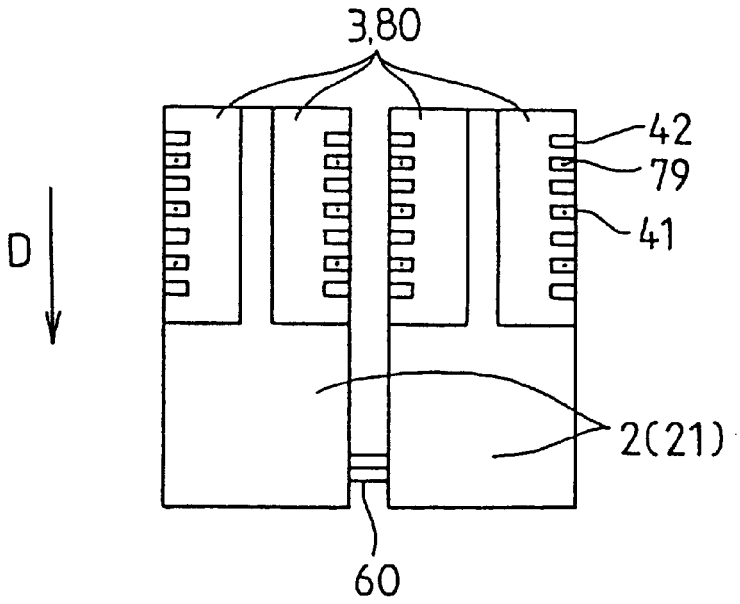
FIG. 7 is a front view of another four-color head unit.
Figure 8:
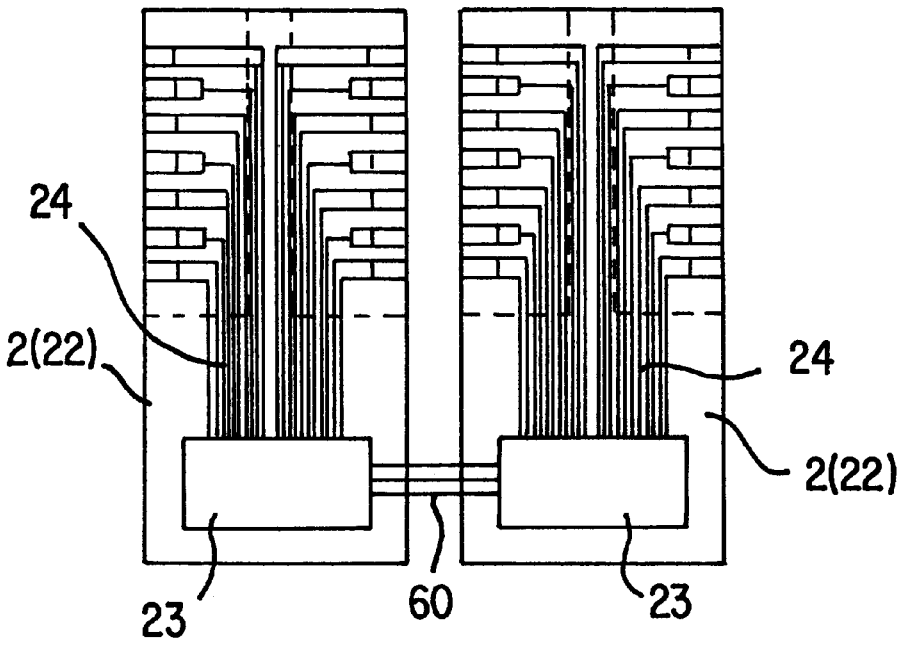
FIG. 8 is a rear view of the four-color head unit shown in FIG. 7.

The 4-color head unit may be of a rectangular shape as shown in FIGS. 5 and 6. Alternatively, as shown in FIGS. 7 and 8, two colors are applied to a single silicon substrate 2, and in the silicon substrates 2, the driver circuits 23 are connected each other by wire bonding 60. In the arrangement as shown in FIGS. 7 and 8, the full length of the printing direction D is shorter as compared with that shown in FIGS. 5 and 6.

According to the ink jet print head and method for producing the same according to the first embodiment described above, it is possible to produce the print head 1 capable of being driven by directly applying the voltage to the driving electrode 30 from the driver circuit 23 and to easily apply it to the multi-color head unit. The wire bonding is necessary for the connection between the driver circuit 23 and the control circuit on the ink jet printer body side, and the same number thereof (except two for voltage terminals and ground terminals) as that of channels (here, 128) per head is merely necessary for the entire unit, and is materially smaller, particularly in case of the multi-color unit, than the prior art which requires the number of channels (in the 4-color unit, 512) of the entire unit.

Figure 9:
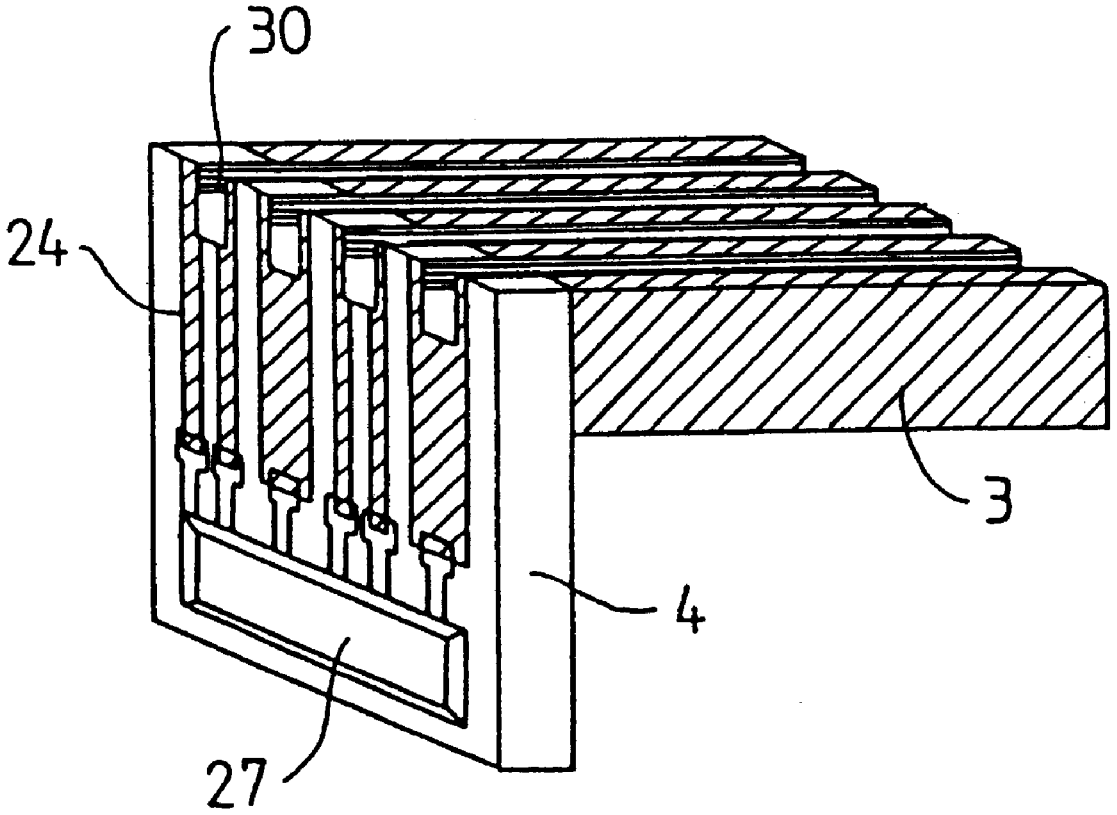
FIG. 9 is a perspective view showing the main parts of an ink jet print head according to a second embodiment of the invention.
Figure 10:
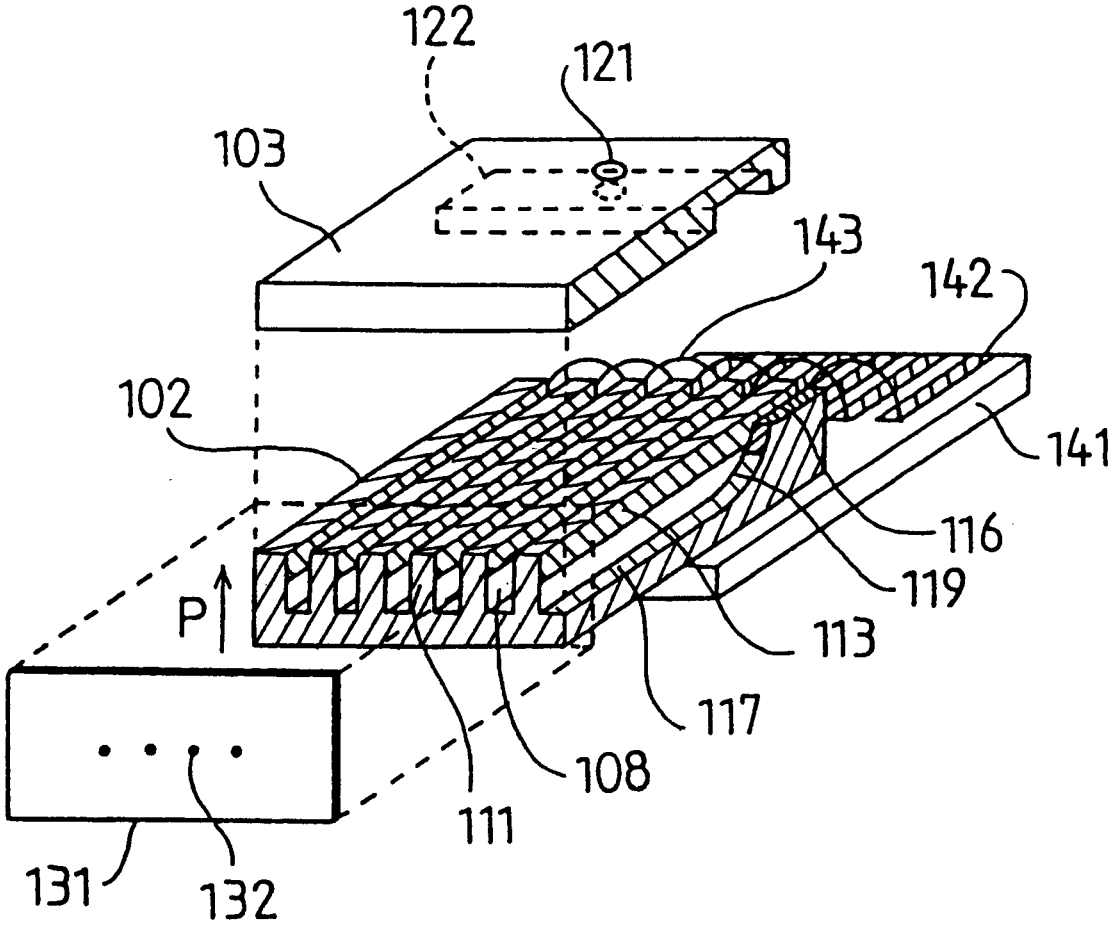
Fig.10 PRIOR ART
FIG. 10 is an exploded perspective view showing a conventional ink jet print head.
Figure 11:
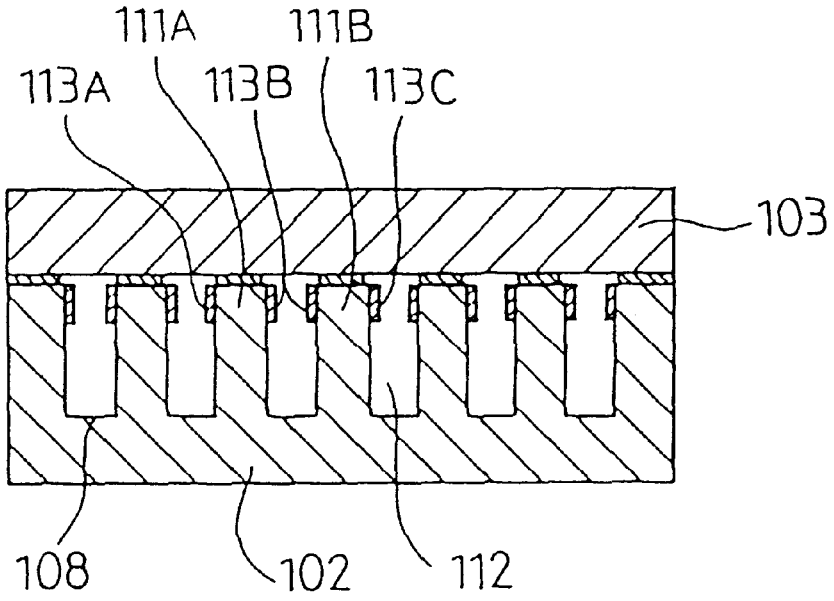
Fig.11 PRIOR ART
FIG. 11 is a sectional view of the conventional ink jet print head.
Figure 12:
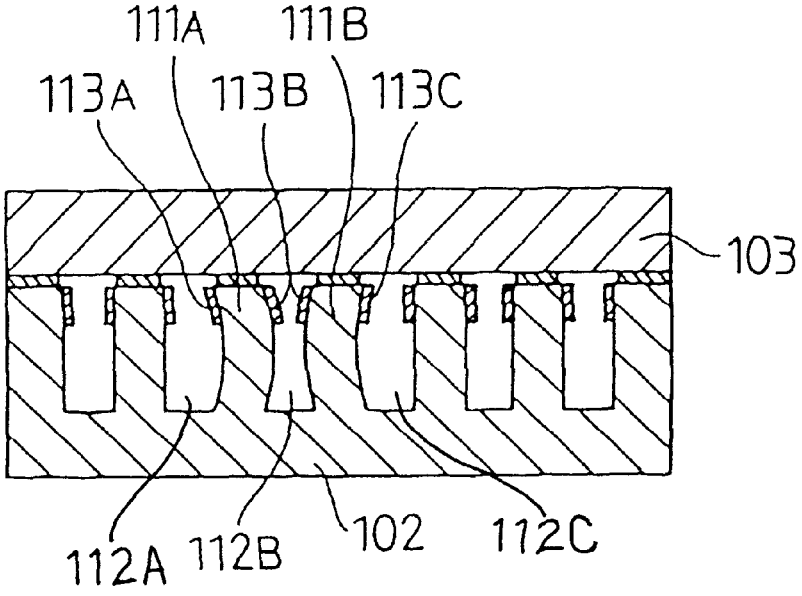
Fig.12 PRIOR ART
FIG. 12 is an explanatory view showing the operating state of the conventional ink jet print head of FIG. 11.

Next, the second embodiment of the present invention will be described. In a print head according to the second embodiment, as shown in FIG. 9, the silicon substrate 2 in the print head 1 of the first embodiment is replaced by a rigid substrate 4, and the driver circuit 23 is incorporated into an IC chip 27 instead of on the substrate. With respect to the rigid substrate 4, a metal foil is affixed to an epoxy prepreg, the rigid substrate 4 being formed with the wiring pattern 24. The driver circuit 23-contained IC chip 27 is connected to the wiring pattern 24 by wire bonding. The printing operation of the print head is similar to that of the first embodiment.

In this case, in the producing method, first, the wiring pattern 24 is formed on the rigid substrate 4 by etching. Then, the IC chip 27 prepared in advance is placed on the rigid substrate 4 and is connected to the wiring pattern 24 by wire bonding. The operations conducted later, such as the adhesion to the actuator plate 3, formation of channels and formation of electrodes are similar to those of the first embodiment.

According to the second embodiment, the print head 1 capable of being driven by directly applying the voltage to the driving electrode 30 from the driver circuit 23 can be produced by the simple method similar to the case of the first embodiment. Further, the application to the multi-color head unit is also easy, similar to the first embodiment.

As described above in detail, according to the first embodiment, the actuator plate 3 and the silicon substrate 2 are adhered together to provide the joined body, which is then formed with the channels and electrodes. It is therefore possible to realize an ink jet print head in which the driving voltage is directly applied to the driving electrode 30 of the piezoelectric actuator. This eliminates the need of the wire bonding for each channel and the electric contact by way of the FPC substrate, and the silicon substrate 2 can be formed in advance with the driver circuit 23 and the wiring pattern 24. It is possible to produce an ink jet print head of high integration by less number of parts and easy producing steps.

Further, the oblique vapor deposition method and the electrolytic gold plating method are employed to form a double-layer driving electrode 30. It is therefore possible to obtain the driving electrode 30 that is positive in electric contact with the wiring pattern 24 and small in electric resistance. Further, a plurality of actuator plates 3 are incorporated into a single silicon substrate 2 for application thereof to a multi-color print head unit, in which case the number of connections between the driver circuit 23 and the control circuit on the ink jet printer body side can be small.

According to the second embodiment, the actuator plate 3 and the rigid substrate 4 are bonded together to provide the joined body, which is formed with channels and electrodes. It is therefore possible to realize an ink jet print head in which the driving voltage is directly applied to the driving electrode 30 of the piezoelectric actuator similarly to the first embodiment and to produce an ink jet print head of high integration by less number of parts and a simple step of production, which is suitable for application to a multi-color print unit. Particularly, this embodiment is advantageous in that the quantity of silicon substrates is sufficient for that of the IC chip 27.

The present invention is not limited to the above-described embodiments and particularly, the various values and usable materials therefor are mere illustrations. Accordingly, it will be readily apparent that in the present invention, various modifications and improvements can be made within the scope of the invention without departing from the subject matter thereof.

What is claimed is:

1. An ink jet print head, comprising:

an actuator plate having a plurality of ink channels formed in a surface thereof, each ink channel including a pair of opposed side walls and a bottom, the actuator plate formed of piezoelectric material and the ink channels expand and contract upon application of a voltage;

a substrate formed of silicon and coupled to the actuator plate to form in cross-section a L-shaped configuation, the substrate having a plurality of ink channels formed in a surface thereof, each ink channel including a pair of opposed side walls and a bottom and being aligned with the channels in the actuator plate;

driving electrodes formed on at least a portion of the side walls of the channels in the actuator plate and the substrate;

a driver circuit formed on the substrate; and a wiring pattern formed on the substrate electrically connected to the driver circuit and directly connected to the driving electrodes, wherein the wiring pattern and the driving electrodes are integrally connected without intervention of wire bonding, and wherein the driver circuit and the wiring pattern are formed as an integrated circuit on the substrate formed of silicon.

2. The ink jet print head of claim 1, wherein the substrate is a semiconductor substrate and the driver circuit is formed thereon.

3. The ink jet print head of claim 2, wherein the driver circuit is formed as a matrix.

4. The ink jet print head of claim 1, further comprising a nozzle plate having nozzles formed therein that are positioned to correspond to the actuator plate and substrate ink channels, the nozzle plate being coupled to an end of the actuator plate to seal one end of the actuator plate and substrate channels, a cover plate coupled to the actuator plate and substrate that covers the actuator plate and substrate channels, and a back sealer plate having ink supply holes therein coupled to the substrate to close the other end of the actuator plate and substrate channels.

5. An ink jet print head, comprising:

an actuator plate having a plurality of ink channels formed in a surface thereof, each ink channel including a pair of opposed side walls and a bottom, the actuator plate formed of piezoelectric material and the channels expand and contract upon application of a voltage;

a substrate coupled to the actuator plate to form in cross-section a L-shaped configuration, the substrate having a plurality of ink channels formed in a surface thereof, each ink channel including a pair of opposed side walls and a bottom and being aligned with the channels in the actuator plate;

driving electrodes formed on at least a portion of the side walls of the channels in the actuator plate and the substrate;

a driver circuit formed on the substrate; and a wiring pattern formed on the substrate electrically connected to the driver circuit and directly connected to the driving electrodes, wherein the wiring pattern and the driving electrodes are integrally connected without intervention of wire bonding, and wherein the substrate is a rigid member and the driver circuit is an IC chip connected to the wiring pattern by wire bonding.

6. The ink jet print head of claim 5, wherein the substrate is formed of an epoxy prepreg with metal foil coupled thereto.

7. The ink jet print head of claim 5, further comprising a nozzle plate having nozzles formed therein that are positioned to correspond to the actuator plate and substrate ink channels, the nozzle plate being coupled to an end of the actuator plate to seal one end of the actuator plate and substrate channels, a cover plate coupled to the actuator plate and substrate that covers the actuator plate and substrate channels, and a back sealer plate having ink supply holes therein coupled to the substrate to close the other end of the actuator plate and substrate channels.

8. An ink jet print head, comprising:

a plurality of actuator plates, each actuator plate having a plurality of ink channels formed in a surface thereof, each ink channel including a pair of opposed side walls and a bottom, each actuator plate is formed of piezoelectric material and the channels expand and contract upon application of a voltage;

a single substrate coupled to the plurality of actuator plates to form in cross-section a L-shaped configuration, the substrate having a plurality of ink channels formed in a surface thereof, each ink channel including a pair of opposed side walls and a bottom and being aligned with the channels in the plurality of actuator plates;

a plurality of driving electrodes formed on at least a portion of the side walls of the channels in each of the actuator plates and the substrate;

a driver circuit formed on the substrate; and a wiring pattern formed on the substrate electrically connected to the driver circuit and directly connected to the driving electrodes, wherein the wiring pattern and the driving electrodes are integrally connected without intervention of wire bonding.

9. The ink jet print head of claim 8, wherein the driver circuit and the wiring pattern are formed as an integrated circuit.

10. The ink jet print head of claim 8, wherein the substrate is a rigid member and the driver circuit is an IC chip connected to the wiring pattern by wire bonding.

11. An ink jet print head, comprising:

a plurality of piezoelectric actuator plates, each piezoelectric actuator plate having channels with electrodes for jetting ink from the channels upon selective application of voltage to the electrodes, the plurality of piezoelectric actuators forming a piezoelectric actuator assembly; and a single substrate connected to the actuator assembly to form in cross-section a L-shaped configuration, the substrate having a driver circuit thereon for providing voltage to the electrodes and an integral wiring pattern for direct electrical connection between the driver circuit and the electrodes, wherein the wiring pattern and the electrodes are directly and integrally joined without intervention of wire bonding.

12. The ink jet print head of claim 11, wherein the single substrate includes a plate with channels formed therein that are aligned with the channels of the piezoelectric actuator plates.

13. The ink jet print head of claim 11, wherein the single substrate comprises a semi-conductor substrate and the driver circuit is formed as a matrix on the semi-conductor substrate and integrally connected to the wiring pattern.

14. The ink jet print head of claim 11, wherein the single substrate comprises a rigid substrate and the driver circuit comprises an IC chip connected to the wiring pattern by wire bonding.

15. The ink jet print head of claim 11, wherein the single substrate is coupled to the plurality of actuator plates for use in a multi-color print head unit.

* * * * *